US005500061A

United States Patent [19]

Warren et al.

[11] Patent Number: 5,500,061

[45] Date of Patent: Mar. 19, 1996

[54] SILICON AS HIGH PERFORMANCE FUEL ADDITIVE FOR AMMONIUM NITRATE PROPELLANT FORMULATIONS

[75] Inventors: Larry C. Warren; Leo K. Asaoka, Stanley; Robert L., all of Huntsville, Ala.

[73] Assignee: The United States of America as represented by the Secretary of the Army, Washington, D.C.

[21] Appl. No.: 215,748

[22] Filed: Mar. 21, 1994

[51] Int. Cl.[6] ..... C06B 45/10

[52] U.S. Cl. ..... 149/19.4; 149/19.5; 149/19.6; 149/21; 149/39; 149/47

[58] Field of Search ..... 149/19.5, 21, 19.9, 149/19, 39, 19.2, 19.4, 38; 102/531; 60/219; 528/417; 525/403

[56] References Cited

U.S. PATENT DOCUMENTS

| | | | |
|---|---|---|---|
| 3,590,583 | 4/1971 | Sayles | 60/219 |
| 4,412,874 | 11/1983 | Huskins et al. | 149/19.2 |
| 4,707,540 | 11/1987 | Manser et al. | 528/417 |
| 5,074,938 | 12/1991 | Chi | 149/21 |
| 5,359,012 | 10/1994 | Ampleman | 525/403 |

*Primary Examiner*—Donald P. Walsh
*Assistant Examiner*—J. R. Hardee
*Attorney, Agent, or Firm*—Anthony T. Lane; Hugh P. Nicholson; Freddie M. Bush

[57] ABSTRACT

The addition of silicon (Si) powder from about 0.40 to 6.00 weight percent to ammonium nitrate (AN) propellant formulations as a fuel source results in a substantial increase in performance specific impulse (Isp). Theoretical Isp of AN propellant can be enhanced to levels approaching conventional in-service propellant formulations containing much more hazardous ingredients. Using inert or energetic polymer binders, AN propellant formulations are possible that will meet the performance requirements of most tactical missile systems when silicon is used as a fuel additive. Silicon powder when used to replace elemental carbon in most formulations has two major advantages: (1) an increase in theoretical Isp and (2) an improved propellant combustion efficiency by increasing propellant burning temperature. An improvement in propellant burning properties are also expected. The adjustment of weight percent ammonium nitrate in the AN propellant formulation is made as the silicon powder is adjusted over the range of 0.40 weight percent to 6.00 to achieve the preferred results. Formulations are mixed, cast and cured by techniques and methods that are commonly used in the industry and that are known by personnel skilled in the art of propellant formulating.

1 Claim, 1 Drawing Sheet

INCREASES OF (ISP) OF AMMONIUM NITRATE PROPELLANTS WITH SILICON POWDER

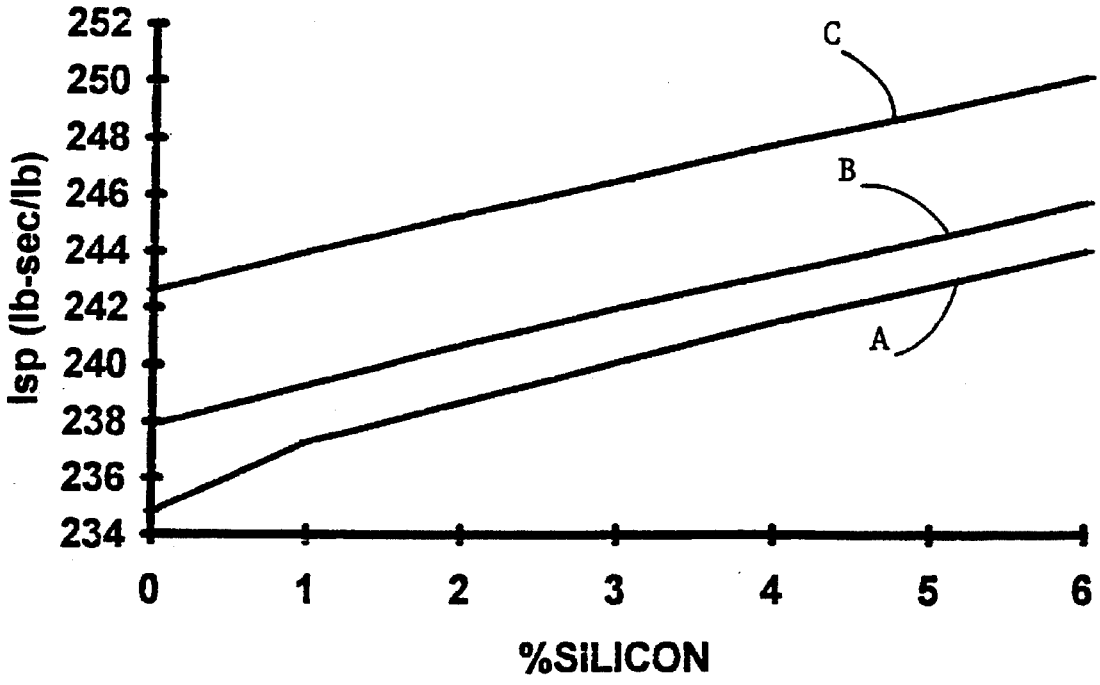
INCREASES OF (ISP) OF AMMONIUM NITRATE PROPELLANTS WITH SILICON POWDER

SILICON AS HIGH PERFORMANCE FUEL ADDITIVE FOR AMMONIUM NITRATE PROPELLANT FORMULATIONS

DEDICATORY CLAUSE

The invention described herein may be manufactured, used, and licensed by or for the Government for governmental purposes without the payment to us of any royalties thereon.

BACKGROUND OF THE INVENTION

The U.S. Army MICOM has conducted many investigations to develop Class 1.3 (<69 cards in the NOL gap test) Insensitive Munitions (IM) minimum signature propellants for its near-term and mid-term tactical missile systems. These next generation propellants contain ammonium nitrate (AN) oxidizer in inert and energetic polymer binders. AN is of interest for its HCl free combustion products, low cost, minimum signature and its insensitivity. However, tradeoffs of performance for insensitivity are made for these AN propellants. AN propellant specific impulse (Isp) values are less than those of current propellants formulated with energetic nitramines cyclotetramethylenetetranitramine/cyclotrimethylenetrinitramine (HMX/RDX) whose theoretical Isps may range from 245–250 seconds. Typical Isps of AN propellants are 228–240 seconds at 1000 psi motor operating pressure.

Some other undesirable features of AN propellant formulations are poor burning properties (low burning rates, high pressure exponents, and high temperature dependency (PiK), and the AN phase change phenomena which can lead to cracked propellant grains during temperature cycling. MICOM has extensively investigated ways to improve these undesirable properties of AN propellants. In addition to energetic nitramines, various burning rate additives have been evaluated to improve AN propellant ballistic and performance properties. Numerous phase stabilizers have been evaluated to prevent AN phase changes during temperature cycling.

Previous efforts to enhance the ballistics and performance of AN propellants, while maintaining Class 1.3 and minimum signature characteristics, have proven to be a most difficult task. Improvement in one area usually translates to a loss in another. Previous work with elemental boron and boron compounds resulted in substantial gains in both propellant burning properties and performance, but with increase of propellant signature and sensitivity. AN propellant containing 0.5% boron failed minimum signature testing which requires visible transmittance of greater than 90 percent. Other additives such as the dodecahydrododecaborane salts ($B_{12}H_2^{-2}$) improved AN propellant burning properties, but with a reduction in Isp performance and poor motor plume signature characteristics.

To enhance the performance of AN propellants while maintaining minimum signature properties, small amounts (<10%) of energetic solid nitramines such HMX, RDX or CL-20 are typically added. Fuel additives such as HMX, or RDX can increase propellant sensitivity to class 1.1. (greater than 69 cards in Naval Ordnance Lab (NOL) gap test).

A fuel additive which does not adversely affect propellant sensitivity, or minimum signature, but which can also improve performance Isp, would be desirable for AN propellants.

Therefore, an object of this invention is to provide a fuel additive that enhances AN propellant performance while not adversely affecting propellant sensitivity or signature of the AN propellant.

Another object of this invention is to provide a fuel additive which is useful with AN propellant with inert or energetic binder systems for increasing burning temperature of the AN propellant and thus enhancing combustion efficiency.

SUMMARY OF THE INVENTION

The performance of AN propellant formulations is enhanced by the addition of small amounts of silicon powder as evidenced by the increase of the measured specific impulse (Isp(sec)). Typically the replacement of one percent of ammonium nitrate with silicon results in a theoretical specific impulse gain of 1.4 seconds. The addition of additional silicon amounts enhances AN propellant performance to levels approaching conventional high performance propellants. Isp of AN propellants with inert polymer binder (PGA), energetic nitramine polymer binder (9DT-NIDA), and energetic glycidyl azide polymer binder (GAP) are illustrated in the single FIGURE of the Drawing, curves A, B, and C, respectively.

Silicon powder of 2.6 and 9.6 microns of average particles size are evaluated in the inert (PGA) polymer configuration (see preferred embodiment Example I). Small test motors (2"×2" and 2"×4") cast with propellant containing different amounts (1, 2, & 3%) of silicon powder are static fired under ambient conditions. Video observations suggest that the propellant containing the 2.6 micron silicon would pass minimum signature analysis at the 3% level. However, the propellant containing 9.6 micron silicon would appear to fail minimum signature at the identical three percent level of silicon. These observations were confirmed by signature analysis of these silicon propellants formulations tested in the MICOM smoke tunnel test facility. Ninety percent or greater transmittance is required for minimum signature classification. Combustion efficiency is expected to increase when silicon powder surface area is increased.

Since silicon is similar to carbon in properties, silicon can be used as a replacement for carbon in any propellant formulation where carbon is used. Carbon is a common ingredient in many propellant formulations. However, when added to propellant formulations, carbon causes a reduction of AN propellant performance Isp (see Table V hereinbelow) and in combustion temperature (see Tables I, II, and III hereinbelow). The addition of silicon increases propellant combustion temperature and Isp performance as depicted in Table IV.

This invention provides a new propellant fuel additive that enhances the performance Isp of AN propellants to levels approaching those of conventional in-service minimum signature propellants. Another added benefit of this invention is that silicon can replace carbon in AN formulations with both a performance gain and an increase in propellant burning temperature. The low burning temperature of AN propellants has been defined as a major cause of its poor ballistic properties.

BRIEF DESCRIPTION OF THE DRAWING

The single FIGURE of the Drawing depicts the increases of specific impulse (Isp) of AN propellants employing inert and energetic binders and varied percentages of silicon.

DESCRIPTION OF THE PREFERRED EMBODIMENT

The solid propellant composition set forth below under Examples I–III illustrate the use of silicon powder as a fuel additive to enhance the performance of ammonium nitrate propellants in three different binder systems. Ingredients listed in Examples I–III are further identified hereinbelow in Table VII.

EXAMPLE I: Inert Polyglycoladipate (PGA) AN Formulation

| Ingredient (abbreviation) | Ingredient and Function | % by Weight |
|---|---|---|
| PGA | Inert polymer binder, polyglycoladipate | 6.47 |
| BTTN | Butanetriol trinitrate - plasticizer | 18.79 |
| TMETN | Trimethylolethane trinitrate - plasticizer | 12.59 |
| AN | Ammonium nitrate - oxidizer | 60.00–54.40 |
| MNA | N-methyl para nitroaniline - stabilizer | 0.50 |
| HMDI | Hexamethylene diisocyanate - curing agent | 1.22 |
| TPB | Triphenylbismuth - cure agent | 0.03 |
| Si | Silicon 0–6.00 | 0.46–6.00* |

*<5 micron average particle size

EXAMPLE II: Energetic Nitramine Polymer (9DT-NIDA) AN Formulation

| Ingredient (abbreviation) | Ingredient and Function | % by Weight |
|---|---|---|
| 9DT-NIDA | Energetic nitramine polymer binder | 8.00 |
| BTTN | Butanetriol trinitrate - plasticizer | 17.86 |
| TMETN | Trimethylolethane trinitrate - plasticizer | 11.90 |
| AN | Ammonium nitrate - oxidizer | 59.60–54.00 |
| MNA | N-methyl para nitroaniline - stabilizer | 0.50 |
| TPB | Triphenylbismuth - cure agent | 0.03 |
| N100 | Triisocyanate curing agent | 1.71 |
| Si | Silicon 0–6.00 | 0.40–6.00* |

*<5 micron average particle size.

EXAMPLE III: Energetic Glycidyl Azide (GAP) Polymer AN Formulation

| Ingredient (abbreviation) | Ingredient and Function | % by Weight |
|---|---|---|
| GAP | Energetic glycidyl azide polymer binder | 8.00 |
| BTTN | Butanetriol trinitrate - plasticizer | 18.42 |
| TMETN | Trimethylolethane trinitrate - plasticizer | 12.28 |
| AN | Ammonium nitrate - oxidizer | 59.60–54.00 |
| MNA | N-methyl para nitroaniline - stabilizer | 0.50 |
| HMDI | Hexamethylene diisocyanate - curing agent | 0.77 |
| TPB | Triphenylbismuth - cure catalyst | 0.30 |
| Si | Silicon 0–6.0 | 0.40–6.00* |

*<5 micron average particle size.

The zero values of silicon are the base values for the identities shown in Tables I–III below (i.e., Isp (sec), Density Isp and Density (g/cc)). The values are for evaluating the changes in Isp (sec) for the propellants with different binders and with varied levels of silicon.

TABLE I

The Addition of Silicon to Inert PGA Polymer AN Formulation

| % Silicon | 0 | 1 | 2 | 3 | 4 | 6 |
|---|---|---|---|---|---|---|
| Isp (sec) | 234.8 | 237.3 | 238.7 | 240.1 | 241.5 | 244.0 |
| Density Isp | 13.5 | 13.6 | 13.7 | 13.9 | 14.0 | 14.2 |
| Density (g/cc) | 1.585 | 1.589 | 1.593 | 1.597 | 1.602 | 1.611 |

TABLE II

The Addition of Silicon to Energetic Nitramine (9DT-NIDA) AN Formulation

| % Silicon | 0 | 1 | 2 | 3 | 4 | 6 |
|---|---|---|---|---|---|---|
| Isp (sec) | 237.9 | 239.3 | 240.7 | 242.0 | 243.2 | 245.7 |
| Density Isp | 13.7 | 13.8 | 13.9 | 14.0 | 14.1 | 14.4 |
| Density (g/cc) | 1.592 | 1.596 | 1.600 | 1.615 | 1.609 | 1.618 |

TABLE III

The Addition of Silicon to Energetic Glycidyl Azide (GAP) Polymer AN Formulation

| % Silicon | 0 | 1 | 2 | 3 | 4 | 6 |
|---|---|---|---|---|---|---|
| Isp (sec) | 242.6 | 244.0 | 245.3 | 246.5 | 247.8 | 250.1 |
| Density Isp | 14.0 | 14.1 | 14.2 | 14.3 | 14.4 | 14.6 |
| Density (g/cc) | 1.595 | 1.599 | 1.604 | 1.608 | 1.613 | 1.622 |

Table IV below indicates the decrease in percent transmittance for 2.6 micron particle size and 9.6 micron particle size as measured in the exhaust plumes of the burning propellant containing 0–4 percent silicon.

TABLE IV

Preliminary Signature Analysis of 2.6 micron and 9.6 micron Average Particle Size Silicon Powder in Propellant Formulations

| % Si | 0 | 3 | 3 | 4 |
|---|---|---|---|---|
| Average sized (micron) | 0 | 2.6 | 9.6 | 9.6 |
| % Transmittance | 99 | 97 | 80 | 78 |

Table V below illustrates the decreases in Isp (sec) and propellant burn temperature (degK.) due to addition of small percent amounts of carbon. The results shown in this table should be reviewed and compared with Table VI data which shows that the addition of silicon increases the burning temperature (degK.) of AN propellants.

TABLE V

The Addition of Small Amounts Of Carbon Decreases Performance and Propellant Burn Temperature.

| % Carbon | 0 | 0.25 | 0.50 | 1.00 |
|---|---|---|---|---|
| Isp (sec) | 235.8 | 235.1 | 234.4 | 233.7 |
| P. Burn Temp (degK) | 2553 | 2535 | 2517 | 2496 |

Table VI below illustrates that the addition of silicon increases the burning temperature (degK.) of AN propellants.

TABLE VI

The Addition of Silicon Increases the Burning Temperature (degK) of AN Propellants.

| % Silicon | 0 | 1 | 2 | 3 | 4 | 6 |
|---|---|---|---|---|---|---|
| PGA/AN Propellant | 2553 | 2593 | 2635 | 2676 | 2715 | 2790 |
| 9DT-NIDA/AN Propellant | 2620 | 2660 | 2701 | 2740 | 2779 | 2850 |
| GAP/AN Propellant | 2706 | 2744 | 2783 | 2821 | 2857 | 2921 |

Table VII, below, identifies the abbreviated ingredients listed under Examples I–III.

TABLE VII

Ingredients Defined

| | |
|---|---|
| PGA | inert polymer binder, polyglycoladipate |
| 9DT-NIDA | energetic nitramine polymer binder |
| GAP | energetic glycidyl azide polymer binder |
| BTTN | butanetriol trinitrate - plasticizer |
| TMETN | trimethylolethane trinitrate - plasticizer |
| AN | ammonium nitrate - oxidizer |
| MNA | N-methyl para nitroaniline - stabilizer |
| HMDI | hexamethylene diisocyanate - curing agent |
| TPB | triphenylbismuth - cure catalyst |
| N100 | triisocyanate curing agent |

We claim:

1. An ammonium nitrate propellant composition selected from an ammonium nitrate propellant composition containing an inert polymer binder as defined under composition (A) hereinbelow or an ammonium nitrate propellant composition containing an energetic polymer binder as defined under composition (B) and composition (C) hereinbelow, said compositions (A), (B), and (C), consisting in weight percents of the ingredients with functions specified as follows:

| Composition A: | |
|---|---|
| Inert polymer binder, polyglycoladipate | 6.47 |
| Butanetriol trinitrate - plasticizer | 18.79 |
| Trimethylolethane trinitrate - plasticizer | 12.59 |
| Ammonium nitrate - oxidizer | 60.00–54.40 |
| N-methyl para nitroaniline - stabilizer | 0.50 |
| Hexamethylene diisocyanate - curing agent | 1.22, |

-continued

| Composition B: | |
|---|---|
| Energetic nitramine polymer binder | 8.00 |
| Butanediol trinitrate - plasticizer | 17.86 |
| Trimethylolethane trinitrate - plasticizer | 11.90 |
| Ammonium nitrate - oxidizer | 59.60–54.00 |
| N-methyl para nitroaniline - stabilizer | 0.50 |
| Triphenylbismuth - cure agent | 0.03 |
| Triisocyanate curing agent | 1.71, |
| and Composition C: | |
| Energetic glycidyl azide polymer binder | 8.00 |
| Butanetriol trinitrate - plasticizer | 18.42 |
| Trimethylolethane trinitrate - plasticizer | 12.28 |
| Ammonium nitrate - oxidizer | 59.60–54.00 |
| N-methyl para nitroaniline - stabilizer | 0.50 |
| hexamethylene diisocyanate - curing agent | 0.77 |
| Triphenylbismuth - cure catalyst | 0.30, |

said compositions (A), (B), and (C) additionally consisting of a silicon powder additive to achieve an improvement in propellant performance Isp, combustion temperature, and combustion efficiency, said silicon powder additive incorporated into said ammonium nitrate propellant composition during propellant mixing in an amount from about 0.40 to about 6.00 weight percent of said silicon powder having a particle size of less than 5 microns average particle size, said improvement based on comparisons of measured specific impulses, density specific impulse, propellant burn temperatures in (degK.), and percent transmittances as determined in signature analysis of exhaust plumes of said ammonium nitrate composition containing said silicon powder as compared with said ammonium nitrate composition containing carbon black additive but no silicon powder, said composition (A) having burn temperatures of 2593 degK. and 2790 degK. with the incorporation of said silicon powder in weight percent of 1 and 6 weight percent, respectively, as compared with 2553 degK. with 0% silicon powder, said composition (B) having burn temperatures of 2660 degK. and 2850 degK. with the incorporation of said silicon powder in weight percent of 1 and 6 weight percent, respectively, as compared with 2620 degK. with 0% silicon powder, and said composition (C) having burn temperatures of 2744 degK. and 2921 degK. with the incorporation of said silicon powder in weight percent of 1 and 6 weight percent, respectively, as compared with 2706 degK. with 0% silicon powder.

* * * * *